US010167639B2

(12) United States Patent
Smith et al.

(10) Patent No.: US 10,167,639 B2
(45) Date of Patent: Jan. 1, 2019

(54) FLUSH FACE WALL TILE

(71) Applicant: Ludowici Roof Tile, Inc., New Lexington, OH (US)

(72) Inventors: Bradley J. Smith, Glouster, OH (US); Joseph B. Shultheis, New Lexington, OH (US)

(73) Assignee: Ludowici Roof Tile, Inc., New Lexington, OH (US)

( * ) Notice: Subject to any disclaimer, the term of this patent is extended or adjusted under 35 U.S.C. 154(b) by 0 days.

(21) Appl. No.: 15/788,285

(22) Filed: Oct. 19, 2017

(65) Prior Publication Data

US 2018/0112415 A1 Apr. 26, 2018

Related U.S. Application Data

(60) Provisional application No. 62/411,164, filed on Oct. 21, 2016.

(51) Int. Cl.

| | |
|---|---|
| ***E04F 13/08*** | (2006.01) |
| ***E04F 13/14*** | (2006.01) |
| ***E04F 13/21*** | (2006.01) |
| ***E04F 13/073*** | (2006.01) |

(52) U.S. Cl.

CPC ..... *E04F 13/0864* (2013.01); *E04F 13/0733* (2013.01); *E04F 13/0801* (2013.01); *E04F 13/0832* (2013.01); *E04F 13/14* (2013.01); *E04F 13/21* (2013.01)

(58) Field of Classification Search

CPC ..... E04F 13/0864; E04F 13/0873; E04F 13/0866; E04F 13/142; E04F 13/0801; E04F 13/21; E04F 13/0876; E04F 13/0733; E04F 13/076; E04F 13/077

See application file for complete search history.

(56) References Cited

U.S. PATENT DOCUMENTS

| | | | | | |
|---|---|---|---|---|---|
| 525,442 | A | * | 9/1894 | Burrows | E04F 13/0864 52/539 |
| 1,492,190 | A | * | 4/1924 | Aycock | E04F 13/0864 52/535 |
| 1,931,709 | A | * | 10/1933 | Schaffert | E04F 13/0864 52/314 |
| 2,835,932 | A | * | 5/1958 | Walton | B32B 21/13 52/560 |
| 3,222,977 | A | * | 12/1965 | Vaughn | F16B 19/1063 411/39 |
| 4,506,486 | A | * | 3/1985 | Culpepper, Jr. | E04D 1/28 52/529 |

(Continued)

FOREIGN PATENT DOCUMENTS

| | | | | | |
|---|---|---|---|---|---|
| GB | 462802 | A | * | 3/1937 | E04F 13/0864 |

*Primary Examiner* — Adriana Figueroa
*Assistant Examiner* — Jessie T Fonseca
(74) *Attorney, Agent, or Firm* — Frost Brown Todd LLC

(57) ABSTRACT

A flush face wall tile is provided that can be installed on an exterior wall of a building to protect it from rain and/or sun. The wall tile may have a tapered profile such that a thickness of the wall tile between a front face wall and a rear wall increases from a bottom portion of the front face wall to an upper portion of the front face wall. A plurality of these wall tiles can be installed on the wall such that the front face walls of each tile are substantially aligned along a longitudinal axis to form a flush exterior wall surface.

20 Claims, 13 Drawing Sheets

(56) References Cited

U.S. PATENT DOCUMENTS

| | | | | |
|---|---|---|---|---|
| 5,501,050 | A * | 3/1996 | Ruel | E04F 13/0864 52/283 |
| 2004/0180195 | A1* | 9/2004 | Macuga | B32B 7/12 428/343 |
| 2009/0308001 | A1* | 12/2009 | Wu | E04L 31/762 52/173.3 |
| 2010/0064611 | A1* | 3/2010 | Holt | E04C 2/243 52/309.4 |
| 2011/0214372 | A1* | 9/2011 | Mullet | E04F 13/075 52/309.4 |
| 2014/0020319 | A1* | 1/2014 | Marchese | E04F 13/0837 52/302.3 |
| 2016/0273218 | A1* | 9/2016 | Gaydos | E04B 9/28 |
| 2017/0234019 | A1* | 8/2017 | Culpepper | B32B 3/06 52/539 |
| 2017/0362830 | A1* | 12/2017 | Buckingham | E04D 1/22 |

* cited by examiner

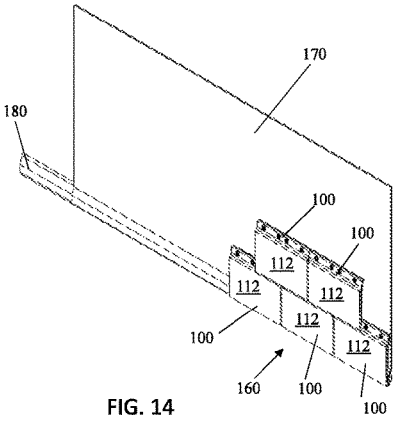
FIG. 14
FIG. 15
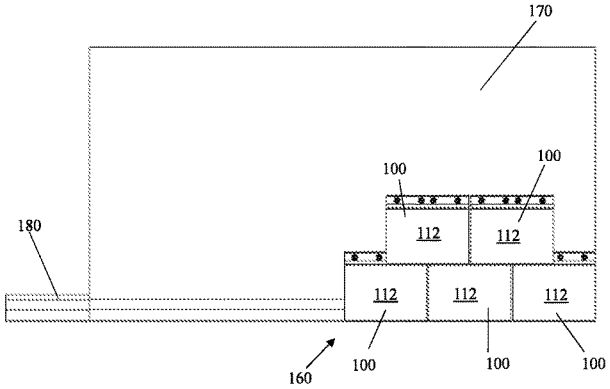

FLUSH FACE WALL TILE

PRIORITY

This application claims priority to U.S. Provisional Patent Application No. 62/411,164, entitled "Flush Face Wall Tile," filed Oct. 21, 2016, the disclosure of which is incorporated by reference herein.

BACKGROUND

Wall tiles can be installed on the exterior wall of a building to protect the building from rain and/or sun. These wall tiles are typically installed using mortar to create a flush surface along the wall. However, using mortar to install the wall tiles can be challenging because the mortar may be difficult to properly mix, the tiles may be difficult to align on the mortar, and the mortar may be messy. Accordingly, there is a need for a wall tile design that is easier to install and maintains a flush surface along the wall.

While a variety of wall tiles have been made and used, it is believed that no one prior to the inventors has made or used an invention as described herein.

BRIEF DESCRIPTION OF THE DRAWINGS

It is believed the present invention will be better understood from the following description of certain examples taken in conjunction with the accompanying drawings, in which like reference numerals identify the same elements.

FIG. 14 depicts a perspective view of the assembled wall tiles of FIG. 10 fastened to a moisture barrier.

FIG. 15 depicts a front view of the assembled wall tiles fastened to the moisture barrier of FIG. 14.

Figure 1:
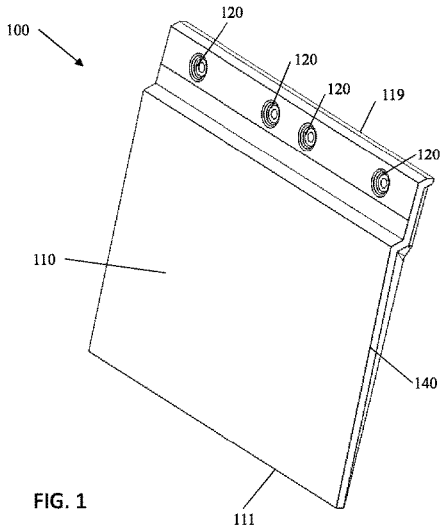
FIG. 1 depicts a front perspective view of a flush face wall tile.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain examples of the invention should not be used to limit the scope of the present invention. Other examples, features, aspects, embodiments, and advantages of the invention will become apparent to those skilled in the art from the following description, which is by way of illustration, one of the best modes contemplated for carrying out the invention. As will be realized, the invention is capable of other different and obvious aspects, all without departing from the invention. Accordingly, the drawings and descriptions should be regarded as illustrative in nature and not restrictive.

There is a desire for exterior wall tiles that are easy to install and that overlay to provide a flush surface along the wall. Such a wall tile is provided having a tapered profile that is easily aligned and fastened to a wall to form a flush surface.

I. An Embodiment of a Flush Face Wall Tile

Figure 2:
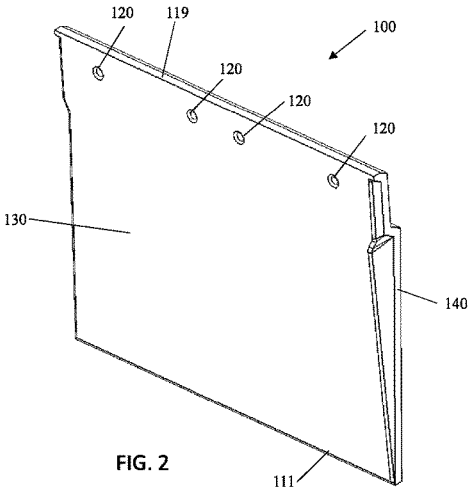
FIG. 2 depicts a rear perspective view of the wall tile of FIG. 1.
Figure 3:
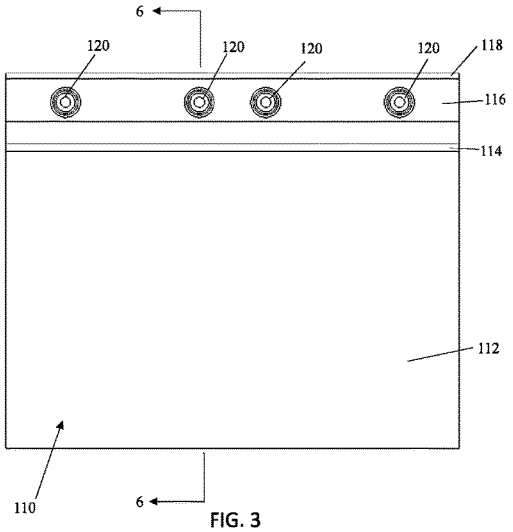
FIG. 3 depicts a front view of the wall tile of FIG. 1.

Referring to FIGS. 1-8, a flush face wall tile (100) is shown that comprises a front surface (110), a rear surface (130), a top surface (119), a bottom surface (111), and opposing side surfaces (140). As best seen in FIGS. 1 and 3, the front surface (110) comprises a front face wall (112), a first angled wall (114) extending upwardly and rearwardly from a top portion of the front face wall (112), an upper wall (116) extending upwardly from a top portion of the first angled wall (114), and a second angled wall (118) extending upwardly and rearwardly from a top portion of the upper wall (116). When the wall tiles (100) are assembled, as will be discussed in more detail below, the front surface (110) may be positioned outward from the wall such that the front face wall (112) is exposed. The front face wall (112) of adjacent tiles (100) are thereby aligned such that each front face wall (112) is flush relative to each adjacent front face wall (112) to form a flush surface along the wall. In the illustrated embodiment, the front face wall (112) comprises a rectangular shape, but other suitable shapes can be used such as square, hexagonal, octagonal, triangular, etc. Accordingly, the front face wall (112) may have a width of about 12 inches, a height of about 8 inches, and a thickness of about 1 inch, but other suitable dimensions can be used.

Figure 6:
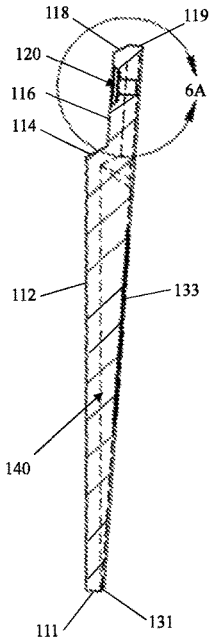
FIG. 6 depicts a cross-sectional view of the wall tile of FIG. 1 taken along line 6-6 of FIG. 3.
Figure 6A:
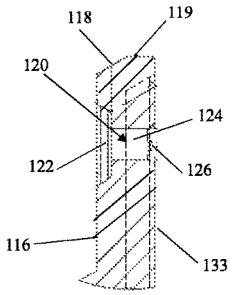
FIG. 6A depicts an enlarged cross-sectional view of a portion of the wall tile of FIG. 6 encircled by line 6A of FIG. 6.
Figure 7:
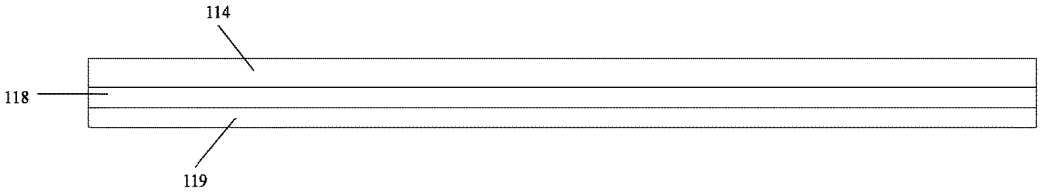
FIG. 7 depicts a top plan view of the wall tile of FIG. 1.
Figure 8:
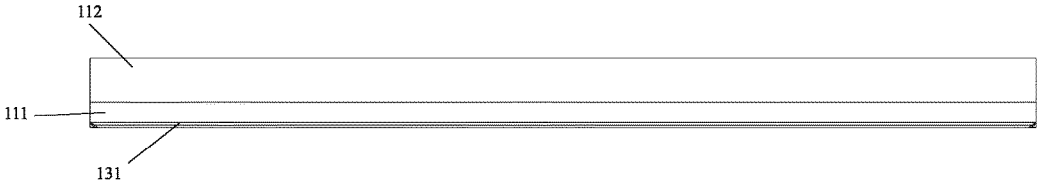
FIG. 8 depicts a bottom plan view of the wall tile of FIG. 1.

In the illustrated embodiment, the first angled wall (118) extends rearwardly from the front face wall (112) about 0.36 inches to form an angle of about 60 degrees relative to the front face wall (112), but other suitable dimensions can be used. The upper wall (116) may then extend upward about 1.75 inches, but other suitable dimensions can be used. As shown in FIG. 3, the upper wall (116) further comprises at least one opening (120) that extends through the upper wall (116) to the rear surface (130) to receive a fastener to attach the wall tile (100) to a wall. An opening (120) of the wall tile (100) is shown in more detail in FIG. 6A, which comprises a substantially cylindrical portion (124) positioned between a first chamfered end (122) and a second chamfered end (126). In the illustrated embodiment, the first chamfered end (122) is positioned at the upper wall (116) and is wider than the second chamfered end (126), positioned at the rear wall (133). For instance, the first chamfered end (122) may taper inwardly to guide a fastener, such as a screw, into the opening (120). The upper wall (116) comprises four openings (120) in the illustrated embodiment such that the central pair of openings (120) are spaced closer together than the outer pair of openings (120), but any other suitable number of openings (120) can be aligned in any suitable configuration to attach the wall tile (100).

Figure 4:
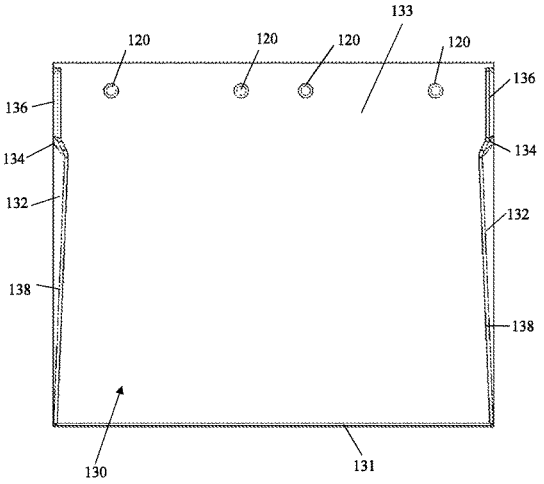
FIG. 4 depicts a rear view of the wall tile of FIG. 1.

Referring back to FIGS. 1 and 3, the second angled wall (118) may extend rearwardly and upwardly from the upper wall (116) about 0.25 inches to form an about 30-degree angle relative to the upper wall (116), but other suitable dimensions can be used. The top surface (119) may then extend rearwardly from a top portion of the second angled wall (118) to the rear surface (130), and the bottom surface (111) may extend rearwardly from a bottom portion of the front face wall (112) to the rear surface (130). As shown in FIGS. 2 and 4, the rear surface (130) of the wall tile (100) comprises a rear wall (133) that may be positioned against a wall when the wall tile (100) is installed. The rear wall (133) may have a width of about 12 inches and a height of about 9.75 inches, but other suitable dimensions can be used.

Figure 5:
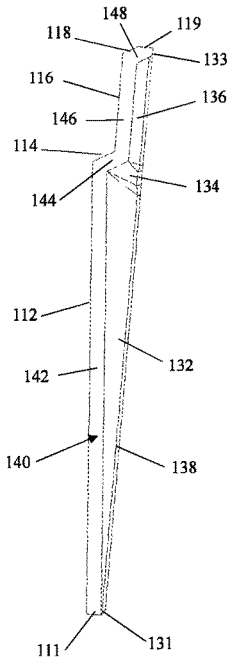
FIG. 5 depicts a side elevational view of the wall tile of FIG. 1.

A side surface (140), as shown in FIG. 5, is positioned on each side of the wall tile (100) to adjoin the front surface (110) with the rear surface (130). It should be noted that each side surface (140) of the wall tile (100) is a mirror image of the other side surface (140) such that the description below applies to each side surface (140) of the wall tile (100). As shown, the side surface (140) extends rearwardly from the front surface (110) of the wall tile (100) such that the side surface (140) has a thickness of about 0.25 inches, but other suitable dimensions can be used. The side surface comprises a first side wall (142) that corresponds to the front face wall (112), a second side wall (144) that corresponds to the first angled wall (114), a third side wall (146) that corresponds to the upper wall (116), and a fourth side wall (148) that corresponds to the second angled wall (118).

Chamfered walls (131, 132, 134, 136, 138) are then provided in the illustrated embodiment between the side surface (140) and the rear surface (130). For instance, a bottom chamfered wall (131) may be angled upward from the bottom surface (111) to the rear wall (133). The first side chamfered wall (132) may be angled inwardly from the first side wall (142). The first side chamfered wall (132) may also be tapered such that the width of the first side chamfered wall (132) is wider at the bottom than at the top. The second side chamfered wall (134) may be angled inwardly from the second side wall (144). The second side chamfered wall (134) may also be tapered such that the width of the second side chamfered wall (134) is wider at the top than at the bottom. The third side chamfered wall (136) may be angled inwardly from the third side wall (146). A fourth side chamfered wall (138) may then extend along each of these first, second, and third side chamfered walls (132, 134, 136) and may be further angled inwardly to the rear wall (133). Such chamfered walls (132, 134, 136) and/or angled walls (114, 118, 131) can assist with alignment of the tiles (100), hide unglazed portions of the tiles (100), and/or guide rainwater.

As shown in FIGS. 5-8, the wall tile (100) comprises a tapered profile such that a thickness of the wall tile (100) increases from a bottom portion of the front face wall (112) to an upper portion of the front face wall (112), and then decreases from the upper portion of the front face wall (112) to the top surface (119). For instance, the thickness of the wall tile (100) may vary from about 0.31 inches at a bottom of the wall tile (100) to about 0.86 inches at the upper portion of the front face wall (112) to about 0.5 inches at the upper wall (116) to about 0.25 inches at the top surface (119). Of course, other suitable dimensions and configurations for the wall tile (100) will be apparent to one with ordinary skill in the art in view of the teachings herein.

II. A Method of Making a Flush Face Wall Tile

A method (150) of making the flush face wall tile (100) described above is shown in FIG. 9, which comprises pressing clay onto molds forming a desired shape to be able to sufficiently dry, fire, and produce an easily installed flush face ceramic wall tile (100). First, raw material (151), such as clay, can be mined and allowed to age or be exposed to a winter prior to processing. Such a freeze-thaw cycle, generally known as weathering, can break down the clay particles to further enhance the ability of the wall tile (100) to absorb moisture when processing. Optionally, the raw material (151) can be ground and mixed with water to allow it to set, or sour, for a period of time prior to introducing it to the forming process. While clay is described in making the tiles (100) to form a ceramic tile, any other suitable material can be used. In the illustrated embodiment, the raw material (151) is inserted into a grinder (152), where the material (151) is ground and/or screened through a fine mesh. The grinder (152) can be an American 384 roll and pan grinder. The ground material, typically at a moisture content of about 10%, can be conveyed to an extruder (153). The extruder (153) can add water, mix, and de-air the material. The extruder (153) can then force the material through a die to achieve a desired shape. This shape can be the final cross-section of tile (100). The extruded cross-section can then be cut with an automatic cutter to desired length and/or nail holes can be punched for fastening.

Figure 9:
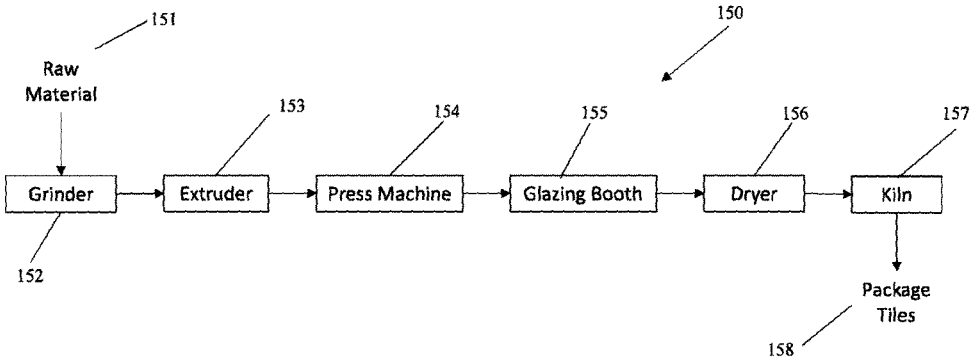
FIG. 9 depicts a schematic of a method to make the wall tile of FIG. 1.
Figure 10:
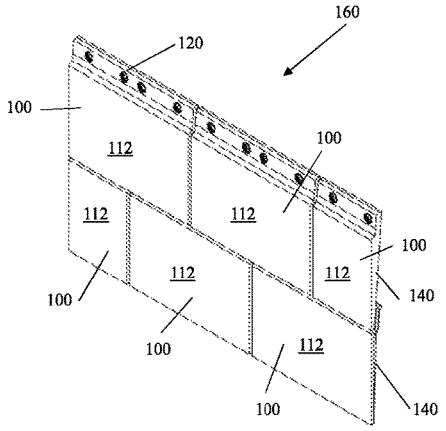
FIG. 10 depicts a perspective view of a plurality of the wall tiles of FIG. 1 assembled to form a wall.

The extruded profile can then be pressed in a mold by press machine (154) to achieve recessed details such as rain bars, side locks, nail head recesses, and/or labeling. The press machine (154) can be supplied by Morando. Due to the shrinkage rate of the raw material (151), this pressing operation may allow for better dimensional control of all four sides of the tile (100). For instance, pressing may provide counter shaping for the variation in the pressed tile density and/or better controlling of the final shape of the product. With extrusion, only two sides can be counter shaped, as compared with all four side when pressing. Pressing may also achieve a reasonably straight final product. The chamfered walls (132, 134, 136) and/or angled walls (114, 118, 131) can assist with the pressing and the forming to achieve a uniform clay tile (100) having a varying body thickness. The trim line of about 0.25 inches around the perimeter of the tile (100) may reduce the pressing pressure. As shown in FIG. 9, the pressed material can be glazed in a glazing booth (155), where the tile (100) can be finished with matt or gloss glazes in any suitable color. The tiles (100) can also be weathered and/or finished with impressionist decorations. The glazing process can include any portion and/or all of the front surface (110), the top surface (119), the bottom surface (111) and/or the side surfaces (140) of the tile (100) to hide the original color of the clay. This may allow the red clay color not to show between gaps when the tiles (100) are installed on a wall.

After glazing, the tiles (100) can be transferred by carts into a dryer (156) that dry the tiles (100) for about 24 hours. Following the drying cycle, the tiles (100) can be transferred to a kiln (157), such as a hydro-casing tunnel kiln, where the tiles (100) can be set onto refractory setters and fired to vitrification. This may produce tiles (100) having a low moisture absorption of typically then about 1%, to provide a rain/sun screen for an exterior wall. The final material is thereby a tight and/or impervious clay body that may last more than about 100 years on an exterior building surface. At the end of the kiln cycle, the tiles (100) can be checked for quality and packaged (158). Of course, other methods for making the wall tiles (100) will be apparent to one with ordinary skill in the art in view of the teachings herein.

III. Installation a Flush Face Wall Tile

FIGS. 10-13A show a plurality of wall tiles (100) assembled to form a wall (160). The rear surface (130) of the tile (100) can be positioned against a surface of a wall. For instance, the tile (100) can be installed over any wall sheathing substrate that can accept fasteners, such as stainless steel screws, and/or over any acceptable air and moisture barrier, such as those that can withstand minimal UV as used with other rain/sun screen products. Once the tile (100) is aligned against the wall as desired, a fastener can be inserted into two or more of the openings (120) to fix the tile (100) to the wall. In the illustrated embodiment, the fastener can be inserted into the opening (120) such that the head of the screw is positioned within the countersunk portion (122) of the opening (120) and is recessed within the tile (100). The number of fasteners used can be between 2 and 4, depending on the desired wind resistance level. For instance, two screws can be used to provide resistance for more than about 100 mph wind speeds, and 4 fasteners can be used to provide resistance for more than about 200 mph wind speeds. Providing four openings (120) for the fasteners may allow for the ability to cut the tiles (100) for end bands or half tiles of varying widths and still maintain the ability for proper fastening. Other methods for fastening the tiles (100) to a wall will be apparent to one with ordinary skill in the art in view of the teachings herein.

Figure 11:
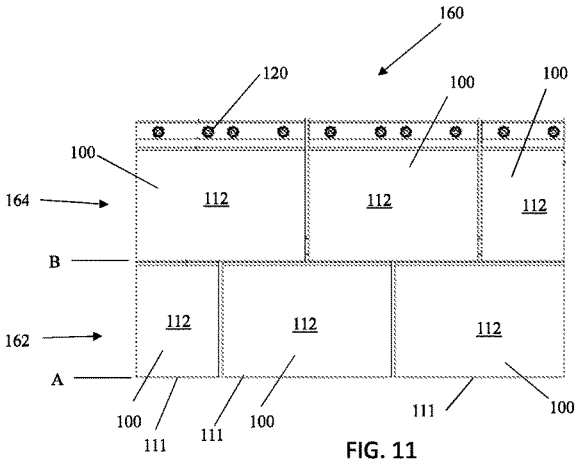
FIG. 11 depicts a front view of the assembled wall tiles of FIG. 10.

Another tile (100) can be fixed to the wall surface as described above adjacent to the first wall tile (100) such that the bottom surfaces (111) of the tiles (100) are aligned along a first lateral axis (A) to form a first row (162), as shown in FIG. 11. For instance, the tiles (100) may be positioned to provide an about 0.25 inch gap between the adjacent side surfaces (140) of the tiles (100). Installations can be varied from about 7.875 to about 8.5 inches in height and about 11.75 to about 12.25 inches in width, but other suitable dimensions can be used. This process may be repeated until the tiles (100) are positioned to cover a desired width of the wall.

Figure 13:
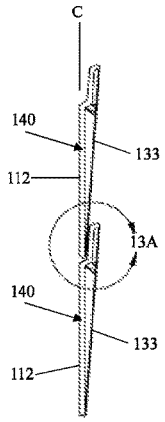
FIG. 13 depicts a side elevational view of the assembled wall tiles of FIG. 10.
Figure 13A:
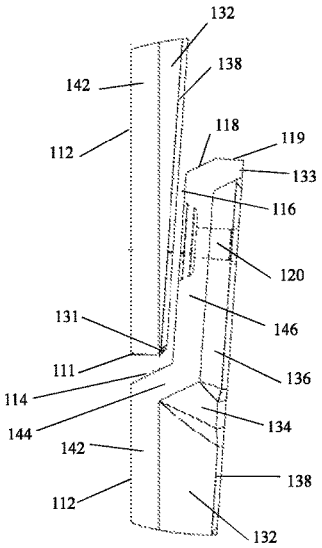
FIG. 13A depicts an enlarged side view of a portion of the assembled wall tiles of FIG. 13 encircled by line 13A of FIG. 13.

A second row (164) of tiles (100) can then be attached to the wall above the first row (162) of tiles (100). This can be done by aligning the bottom portion of a tile (100) over the upper wall (116) of the first tile (100) to conceal the openings (120) and fasteners of the first tile (100) with the bottom portion of the tile (100), as best seen in FIGS. 13 and 13A. In the illustrated embodiment, about 1.75 inches of the bottom portion of the tile (100) overlaps with the upper wall (116) of the first tile (100) such that the bottom surface (111) of the upper tile (100) is approximately aligned with the top portion of the first angled wall (114) of the lower tile (100). This may provide an about 0.268 inch gap between the bottom surface (111) of the upper tile (100) and the first angled wall (114) of the lower tile (100) at the front surface (110) of the tiles (100), but other suitable dimensions can be used. The upper tile (100) can also be positioned to provide an about 0.066 inch gap between the rear surface (130) of the upper tile (100) and the upper wall (116) of the lower tile (100), but other suitable dimensions can be used. Another tile (100) can be fixed to the wall surface as described above adjacent to the upper wall tile (100) such that the bottom surfaces (111) of the tiles (100) are aligned along a second lateral axis (B) to form a second row (164), as shown in FIG. 11. This process may be repeated until the tiles (100) are positioned to cover a desired width and/or height of the wall.

Figure 12:
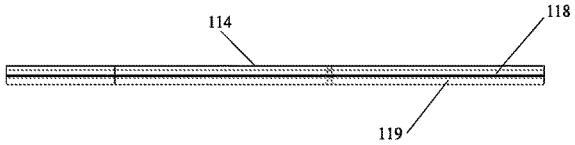
FIG. 12 depicts a top plan view of the assembled wall tiles of FIG. 10.

Accordingly, the plurality of tiles (100) are installed such that the front face walls (112) of each tile (100) are substantially vertically aligned along a longitudinal axis (C) to form a flush exterior wall surface, as best seen in FIGS. 12 and 13. The tapered profile of the tiles (100) thereby account for the overlapping portions of the tiles (100) to maintain a flush front wall (110) surface. Referring back to FIGS. 10-11, the plurality of tiles (100) can be installed in a staggered pattern between rows (162, 164), but such a pattern can be varied to achieve several designs. Still other suitable assembly configurations for the tiles (100) can be used as will be apparent to one with ordinary skill in the art in view of the teachings herein.

Figure 16:
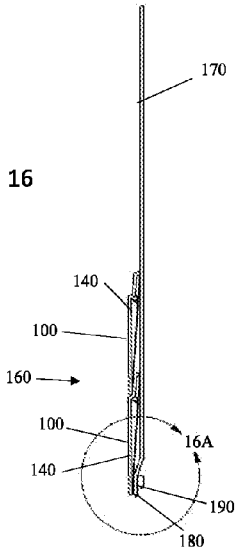
FIG. 16 depicts a side elevational view of the assembled wall tiles fastened to the moisture barrier of FIG. 14.
Figure 16A:
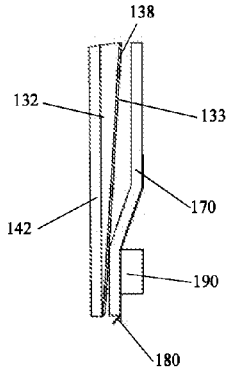
FIG. 16A depicts an enlarged side view of a portion of the assembled wall tiles of FIG. 16 encircled by line 16A of FIG. 16.
Figure 17:
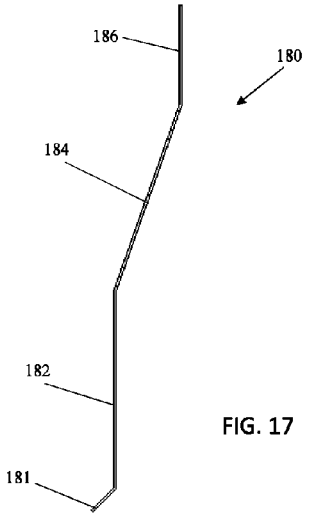
FIG. 17 depicts a side elevational view of a flashing of the assembled wall tiles fastened to the moisture barrier of FIG. 14.

For instance, FIGS. 14-17 show a plurality of tiles (100) attached to a moisture barrier (170) with a base flashing (180). The moisture barrier (170) can be a dry sheet such as those manufactured by Masonry Technology, Inc. in Cresco, Iowa. The base flashing (180) can be a copper base flashing with an angled profile as shown in FIG. 17 with a first vertical wall (186), an angled wall (184) that extends downwardly and outwardly from the first vertical wall (186), a second vertical wall (182) extending downward from the angled wall (184), and a flange (181) extending downwardly and outwardly from the second vertical wall (182). Accordingly, the flashing (180) can be attached to a wall support (190) at the second vertical wall (182), as shown in FIGS. 16 and 16A. In the illustrated embodiment, the moisture barrier (170) is then attached over the flashing (180). The moisture barrier (170) can have a profile that is shaped to correspond to the profile of the flashing (180) such that the moisture barrier (170) is adjacent to the walls (182, 184, 186) of the flashing (180). The flange (181) of the flashing (180) may then protrude from underneath of the moisture barrier (170). Tiles (100) may then be positioned over the moisture barrier (170) such that the bottom surface (111) of the tiles (100) are aligned with the bottom portion of the moisture barrier (170). The angled profile of the moisture barrier (170) and/or flashing (180) thereby can accommodate for the tapered profile of the tiles (100) to form a flush exterior surface of the tiles (100), as shown in FIGS. 14-15. As best seen in FIGS. 16 and 16A, the rear wall (133) is positionable against the wall surface, or moisture barrier (170), such that the front face wall (112) is aligned substantially parallel to the wall surface. In some instances, the front face wall (112) may be slightly offset relative to the wall surface, so long as the front face wall (112) is sufficiently positioned to provide a relatively flush exterior surface between the adjacent front face walls (112) when viewed by an eye of an observer.

The simple screw-on installation of the tiles (100) thereby provides a versatile and easy-to-install cladding solution that is mortar-free. The multiple counter-sunk fastener openings (120) are pre-formed in the clay prior to firing, which may facilitate a secure and simple installation of the tiles (100). The position of the openings (120) may further allow for easy cutting of half-width tiles (100). The flush exterior surface of the wall tiles (100) provides a visual aesthetic not currently available in rain screen cladding systems. The minimal rain screen system cross-section of the tiles (100) allows for curvatures in wall applications and a ventilated wall façade with adjustable exposure. Further, the glazed side surfaces (140) of the tiles (100) may hide the clay-red body of the tiles (100) in gaps between tiles (100) for a consistent wall color. These tiles (100) may provide a long life expectancy with little to no maintenance and a low moisture absorption and freeze-thaw resistance as defined by ASTM C1088.

IV. An Embodiment of a Flush Corner Wall Tile

Figure 18:
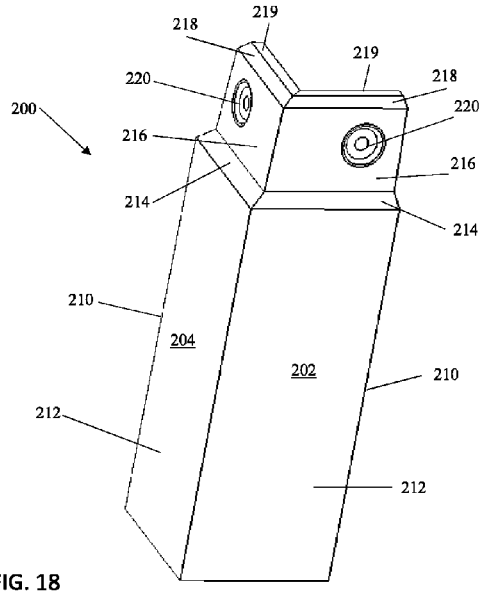
FIG. 18 depicts a front perspective view of a corner tile for use with the wall tile of FIG. 1.
Figure 19:
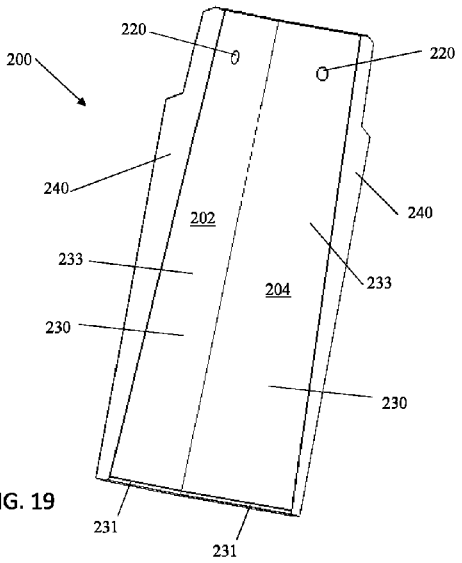
FIG. 19 depicts a rear perspective view of the corner tile of FIG. 18.
Figure 20:
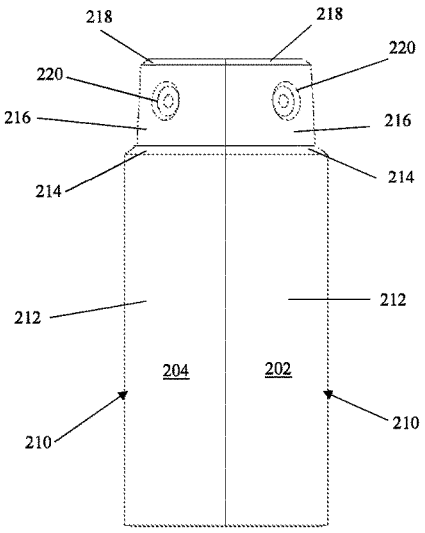
FIG. 20 depicts a front view of the corner tile of FIG. 18.
Figure 21:
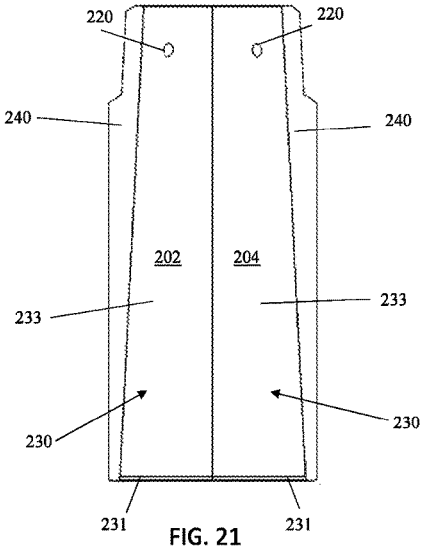
FIG. 21 depicts a rear view of the corner tile of FIG. 18.
Figure 22:
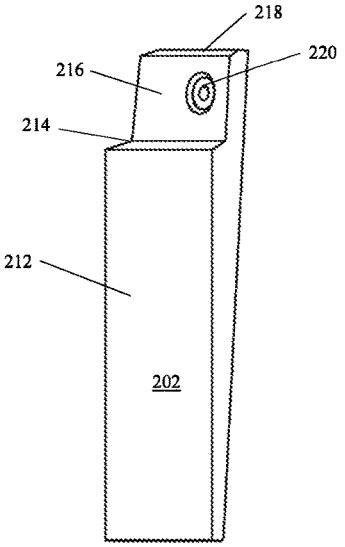
FIG. 22 depicts a side elevational view of the corner tile of FIG. 18.

In some instances, it may be desirable to provide a flush face exterior on a corner of adjoining walls in addition to the wall surfaces. Accordingly, a flush face corner wall tile (200) is provided, as shown in FIGS. 18-25. The corner wall tile (200) is similar to the wall tile (100) as described above, except that the corner wall tile (200) comprises a first portion (202) and a second portion (204) positioned transversely relative to each other. As best seen in FIGS. 18, 20 and 22, each portion (202, 204) of the corner wall tile (200) comprises a front surface (210) having a front face wall (212), a first angled wall (214) extending upwardly and rearwardly from a top portion of the front face wall (212), an upper wall (216) extending upwardly from a top portion of the first angled wall (214), and a second angled wall (218) extending upwardly and rearwardly from a top portion of the upper wall (216). When the corner wall tiles (200) are assembled, as will be discussed in more detail below, the front surfaces (210) may be positioned outward from the walls such that the front face walls (212) are exposed. The front face walls (212) of adjacent tiles (200) are thereby aligned such that each front face wall (212) is flush relative to each adjacent front face wall (212) to form a flush surface along the corner of the walls.

In the illustrated embodiment, the upper wall (216) of each portion (202, 204) comprises an opening (220), similar to opening (120), that extends through the upper wall (216) to the rear surface (230) to receive a fastener to attach the corner wall tile (200) to a wall. A top surface (219) may then extend rearwardly from a top portion of the second angled wall (218) to the rear surface (230), and a bottom surface (211) may extend rearwardly from a bottom portion of the front face wall (212) to the rear surface (230). As shown in FIGS. 19 and 21, the rear surface (230) of each portion (202, 204) of the corner wall tile (200) comprises a rear wall (233) that may be positioned against a wall when the corner wall tile (200) is installed. A side surface (240), as shown in FIG. 22, is positioned on each side of the corner wall tile (200) to adjoin the front surface (210) with the rear surface (230). The corner wall tile (200) thereby comprises a tapered profile such that a thickness of the wall tile (200) increases from a bottom portion of the front face wall (212) to an upper portion of the front face wall (212), and then decreases from the upper portion of the front face wall (212) to the top surface (219).

Figure 23:
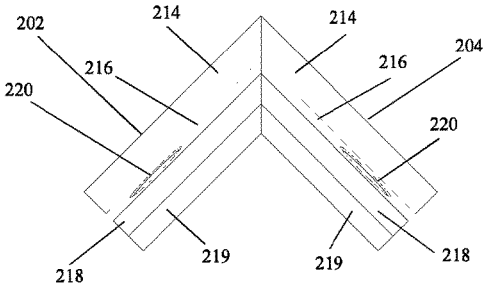
FIG. 23 depicts a top plan view of the corner tile of FIG. 18.
Figure 24:
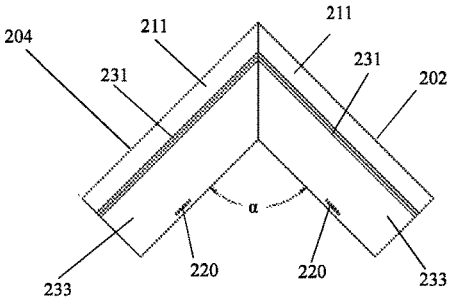
FIG. 24 depicts a bottom plan view of the corner tile of FIG. 18.

As best seen in FIGS. 23-24, the rear surfaces (230) of each portion (202, 204) of the corner wall tile (200) forms an angle $\alpha$ relative to each other. In the illustrated embodiment, the angle $\alpha$ is about 90 degrees, but other suitable angles may be used. Each front surface (210) of the corner wall tile (200) may have a width of about 3 inches and a length to correspond to the length of the wall tile (100). The thickness of the corner wall tile (200) may be about 1 inch. Still other suitable configurations for the corner wall tile (200) will be apparent to one with ordinary skill in the art in view of the teachings herein.

Figure 25:
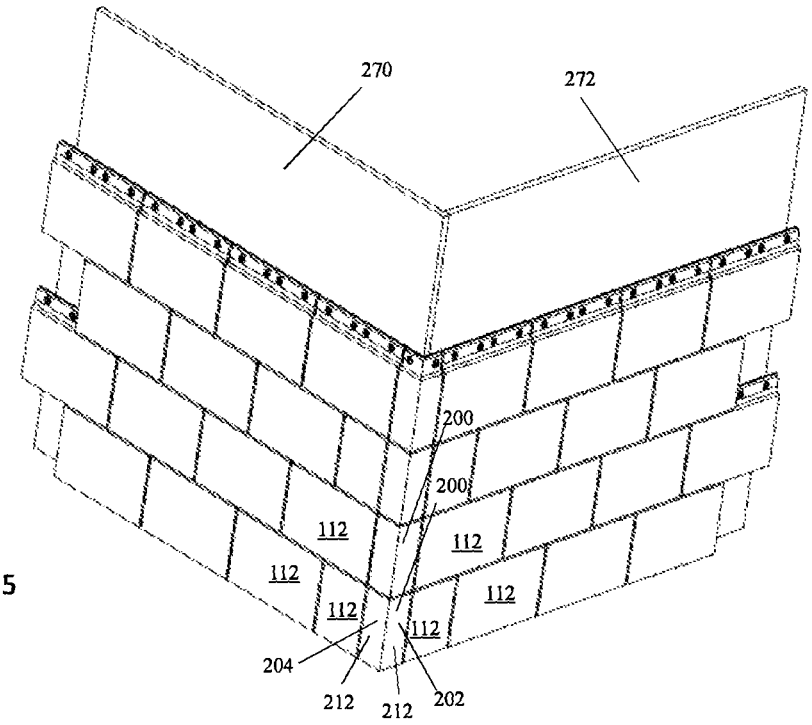
FIG. 25 depicts a perspective view of a plurality of corner tiles of FIG. 18 assembled with a plurality of wall tiles of FIG. 1 to form a corner wall.

Accordingly, the corner wall tile (200) can be installed on adjoining wall surfaces to provide a flush face corner, as shown in FIG. 25. The rear surfaces (230) of the corner wall tile (200) can be positioned against a surface of adjoining walls. For instance, in the illustrated embodiment, the rear surface (230) of the first portion (202) of the corner wall tile (200) is positioned against a first wall (272) and the rear surface (230) of the second portion (204) of the corner wall tile (200) is positioned against a second adjoining wall (270). The tile (200) can be installed over any wall sheathing substrate that can accept fasteners, such as stainless steel screws, and/or over any acceptable air and moisture barrier, such as those that can withstand minimal UV as used with other rain/sun screen products. Once the tile (200) is aligned against the wall as desired, a fastener can be inserted into the openings (220) to fix the tile (200) to the walls (270, 272). In the illustrated embodiment, the fastener can be inserted into the openings (220) such that the head of the screw is positioned within the countersunk portion of the opening (1220) and is recessed within the tile (200). Other methods for fastening the tiles (200) to a wall will be apparent to one with ordinary skill in the art in view of the teachings herein.

Another corner wall tile (200) can then be fixed to the wall surface as described above the first corner wall tile (200). This can be done by aligning the bottom portion of a tile (200) over the upper wall (216) of the first tile (200) to conceal the openings (220) and fasteners of the first tile (200) with the bottom portion of the tile (200). This process may be repeated until the tiles (200) are positioned to cover a desired height of the walls (270, 272). Wall tiles (100) may then be aligned with the corner tiles (200) and attached to the walls (270, 272) to form rows of tiles (100, 200) over a desired portion of the walls (270, 272) to form a flush face exterior wall surface. Other methods for assembling the wall tiles (100, 200) will be apparent to one with ordinary skill in the art in view of the teachings herein.

EXAMPLES

In one embodiment, a flush face wall tile may comprise a front surface having a front face wall, a rear surface having a rear wall, a top surface, a bottom surface, and opposing side surfaces. The wall tile may comprise a tapered profile such that a thickness of the wall tile between the front face wall and the rear wall increases from a bottom portion of the front face wall to an upper portion of the front face wall. The rear wall may be positionable adjacent to a wall surface such that the front face wall is aligned substantially parallel to the wall surface. The front face wall may a rectangular shape. The front surface may further comprise a first angled wall extending upwardly and rearwardly from the upper portion of the front face wall, an upper wall extending upwardly from a top portion of the first angled wall, and a second angled wall extending upwardly and rearwardly from a top portion of the upper wall. At least one opening may extend from the front surface to the rear surface, wherein the opening is configured to receive a fastener to attach the wall tile to a wall surface. The at least one opening may comprise a substantially cylindrical portion positioned between a first chamfered end and a second chamfered end. The wall tile may comprise a first outer opening, a first inner opening, a second inner opening, and a second outer opening aligned along an axis such that the first inner opening is spaced closer to the second inner opening than to the first outer opening and the second inner opening is spaced closer to the first inner opening than to the second outer opening. Chamfered walls may be positioned between the opposing side surfaces and the rear surface such that the chamfered walls are angled inwardly from the opposing side surfaces to the rear surface. The wall tile may be ceramic. The wall tile may be pressed in a mold. The front surface and the opposing side surfaces may be finished with a glaze. The wall tile may comprise a first portion and a second portion positioned at about a 90-degree angle relative to each other.

In another embodiment, a flush face wall may comprise a plurality of wall tiles, wherein each wall tile of the plurality of wall tiles may comprise a front surface having a front face wall, wherein each wall tile of the plurality of wall tiles may comprise a tapered profile such that a thickness of the wall tile increases from a bottom portion of the front face wall to an upper portion of the front face wall, wherein a bottom portion of a first wall tile overlays a top portion of a second wall tile such that the front face wall of the first wall tile is aligned with the front face wall of the second wall tile along a longitudinal axis. The bottom portion of the first wall tile may cover at least one opening formed in the top portion of the second wall tile. A third wall tile may be positioned adjacent to the first wall tile such that a bottom surface of the third wall tile is aligned with a bottom surface of the first wall tile along a first lateral axis to form a first row, wherein a fourth wall tile may be positioned adjacent to the second wall tile such that a bottom surface of the fourth wall tile is aligned with a bottom surface of the second wall tile along a second lateral axis substantially parallel with the first lateral axis to form a second row. The second row may be staggered relative to the first row such that a side surface of the first wall tile is vertically aligned with a central portion of the front face wall of the second wall tile. The third wall tile may be positioned adjacent to the first wall tile to form a gap between a side surface of the third wall tile and a corresponding side surface of the first wall tile, wherein the fourth wall tile may be positioned adjacent to the second wall tile to form a gap between a side surface of the fourth wall tile and a corresponding side surface of the second wall tile.

A method of installing a flush face wall tile may comprise the steps of attaching a rear surface of a first wall tile against a wall surface, and attaching a rear surface of a second wall tile against the wall surface above the first wall tile such that a bottom portion of the second wall tile overlays a top portion of the first wall tile, wherein a front face wall of the second wall tile is aligned with a front face wall of the first wall tile along a longitudinal axis to form a flush surface between the front face wall of the second wall tile and the front face wall of the first wall tile. The method may further comprise attaching a rear surface of a third wall tile against the wall surface adjacent to the first wall tile such that there is a gap between a side surface of the third wall tile and a side surface of the first wall tile. The second wall tile may be staggered relative to the first wall tile such that a side surface of the second wall tile is aligned with a central portion of the front face wall of the first wall tile. The rear surfaces of each of the first and second wall tiles may be positioned against a moisture barrier.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometrics, materials, dimensions, ratios, steps, and the like discussed above are illustrative and are not required. Accordingly, the scope of the present invention should be considered in terms of any claims that may be presented and is understood not to be limited to the details of structure and operation shown and described in the specification and drawings.

What is claimed is:

1. A flush face wall tile assembly comprising at least two wall tiles, wherein each wall tile of the wall assembly comprises:

a front surface comprising
a front face wall;
a rear surface comprising a rear wall;
a top surface;
a bottom surface; and
opposing side surfaces;
wherein each wall tile comprises a tapered profile such that a thickness of the wall tile between the front face wall and the rear wall increases from a bottom portion of the front face wall to an upper portion of the front face wall;
wherein the rear wall of each wall tile is positionable adjacent to a wall surface such that the front face wall is aligned substantially parallel to the wall surface;
wherein each wall tile is ceramic;
wherein the at least two wall tiles are positioned adjacent to each other to align the front face walls of each wall tile along a plane coplanar with each other such that a gap is formed and maintained between the front face walls of each wall tile.

2. The flush face wall tile assembly of claim 1, wherein the front face wall of each wall tile comprises a rectangular shape.

3. The flush face wall tile assembly of claim 1, wherein the front surface of each wall tile comprises:

a first angled wall extending upwardly and rearwardly from a top portion of the front face wall such that the first angled wall is oriented at an acute angle relative to a plane coplanar with the front face wall,
an upper wall extending upwardly from a top portion of the first angled wall, and
a second angled wall extending upwardly and rearwardly from a top portion of the upper wall such that the second angled wall is oriented at an acute angle relative to a plane coplanar with the upper wall.

4. The flush face wall tile assembly of claim 3, wherein the angle between the second angled wall and the upper wall is different than the angle between the first angled wall and the front face wall.

5. The flush face wall tile assembly of claim 3, further comprising at least one opening extending from the upper wall to the rear wall, wherein the opening is configured to receive a fastener to attach the wall tile to a wall surface.

6. The flush face wall tile assembly of claim 5, wherein the at least one opening comprises a substantially cylindrical portion positioned between a first chamfered end and a second chamfered end.

7. The flush face wall tile assembly of claim 5, wherein each wall tile comprises a first outer opening, a first inner opening, a second inner opening, and a second outer opening aligned along an axis such that the first inner opening is spaced closer to the second inner opening than to the first outer opening and the second inner opening is spaced closer to the first inner opening than to the second outer opening.

8. The flush face wall tile assembly of claim 1, wherein each wall tile further comprises chamfered walls positioned between the opposing side surfaces and the rear surface such that the chamfered walls are angled inwardly from the opposing side surfaces to the rear surface.

9. The flush face wall tile assembly of claim 1, wherein the front surface and the opposing side surfaces are finished with a glaze.

10. The flush face wall tile assembly of claim 1, wherein each wall tile comprises a first portion and a second portion positioned transversely relative to each other.

11. The flush face wall tile assembly of claim 10, wherein the first portion is positioned at about a 90 degree angle relative to the second portion.

12. A flush face wall comprises a plurality of wall tiles, wherein each wall tile of the plurality of wall tiles comprises a front surface having a front face wall and an upper wall, wherein a length of the front face wall is larger than a length of the upper wall of each wall tile, wherein each wall tile of the plurality of wall tiles comprises a tapered profile such that a thickness of the wall tile increases from a bottom portion of the front face wall to an upper portion of the front face wall, wherein each wall tile is ceramic, wherein a first wall tile is positioned relative to a second wall tile to align the front face walls of the first and second wall tiles along a plane coplanar with each other, wherein a side surface of the first wall tile is aligned with a corresponding side surface of the second wall tile to form a gap between the side surfaces of the first and second wall tiles to ventilate a rear surface of the first and second wall tiles through the gap between the side surfaces.

13. The flush face wall of claim 12, wherein a third wall tile is positioned above the first wall tile such that a bottom portion of the third wall tile overlays a top portion of the upper wall of the first wall tile such that the front face walls of the first and third wall tiles are aligned along a plane coplanar with each other.

14. The flush face wall of claim 13, wherein the bottom portion of the third wall tile covers at least one opening formed in the top portion of the first wall tile.

15. The flush face wall of claim 13, wherein the third wall tile is staggered relative to the first wall tile such that a side surface of the third wall tile is vertically aligned with an interior portion of the front face wall of the first wall tile.

16. The flush face wall of claim 13, wherein the third wall tile is positioned adjacent to the first wall tile to form a gap between a bottom surface of the front face wall of the third wall tile and a top surface of the front face wall of the first wall tile.

17. A method of installing a flush face wall tile comprising the steps of:

attaching a first wall tile to a wall surface with a rear surface of a first wall tile positioned against the wall surface; and attaching a second wall tile to the wall surface with a rear surface of the second wall tile positioned against the wall surface above the first wall tile such that a bottom portion of the second wall tile overlays a top portion of the first wall tile;

wherein a front face wall of the second wall tile is aligned with a front face wall of the first wall tile along a longitudinal axis to form a flush surface between the front face wall of the second wall tile and the front face wall of the first wall tile;

wherein a gap is provided between a bottom edge of the front face wall of the second wall tile a top edge of the front face wall of the first wall tile without mortar;

wherein the first and second wall tiles are ceramic.

18. The method of claim 17, further comprising attaching a third wall tile to the wall surface adjacent to the first wall tile such that there is a gap between a side surface of the third wall tile and a side surface of the first wall tile.

19. The method of claim 17, wherein the second wall tile is staggered relative to the first wall tile such that a side surface of the second wall tile is aligned with an interior portion of the front face wall of the first wall tile.

20. The method of claim 17, wherein the rear surfaces of each of the first and second wall tiles are positioned against a moisture barrier.

* * * * *